US009036838B2

(12) United States Patent
Chen et al.

(10) Patent No.: US 9,036,838 B2
(45) Date of Patent: May 19, 2015

(54) DUAL-DIAPHRAGM ACOUSTIC TRANSDUCER

(71) Applicant: MERRY ELECTRONICS (SHENZHEN) CO., LTD., Shenzhen (TW)

(72) Inventors: Jen-Yi Chen, Taichung (TW); Chao-Sen Chang, Taichung (TW); Chun-Chieh Wang, Taichung (TW); Yong-Shiang Chang, Taichung (TW)

(73) Assignee: MERRY ELECTRONICS (SHENZHEN) CO., LTD., Shenzhen (CN)

( * ) Notice: Subject to any disclaimer, the term of this patent is extended or adjusted under 35 U.S.C. 154(b) by 43 days.

(21) Appl. No.: 13/939,454

(22) Filed: Jul. 11, 2013

(65) Prior Publication Data

US 2015/0016656 A1 Jan. 15, 2015

(51) Int. Cl.
*H04R 25/00* (2006.01)
*H04R 7/16* (2006.01)

(52) U.S. Cl.
CPC ..... *H04R 7/16* (2013.01)

(58) Field of Classification Search
CPC ..... H04R 1/26; H04R 1/323; H04R 1/345; H04R 1/1016; H04R 1/1058; H04R 5/02; H04R 7/16; H04R 25/00; H04R 25/652; H04R 19/00; H04R 19/04; H04R 19/016; H04R 19/005; H04R 2201/107; H04R 2420/07
USPC ..... 381/174, 380; 181/144
See application file for complete search history.

(56) References Cited

U.S. PATENT DOCUMENTS 6,188,775 B1 * 2/2001 Azima et al. ..... 381/425
2003/0099371 A1 * 5/2003 Ogura et al. ..... 381/426

* cited by examiner

*Primary Examiner* — Brian Ensey
(74) *Attorney, Agent, or Firm* — Bacon & Thomas, PLLC

(57) ABSTRACT

A dual-diaphragm acoustic transducer includes a substrate defining an opening, an inner diaphragm and an outer diaphragm concentrically mounted at one same side of the substrate corresponding to the opening of the substrate, and a plurality of elastic supporting members connected between the outer perimeter of the inner diaphragm and the inner perimeter of the outer diaphragm. Thus, when a sound wave enters the opening of the substrate, the sound wave pressure forces the outer diaphragm to displace and to carry the inner diaphragm to move, and the inner diaphragm itself will also be forced by the sound wave pressure to have a larger displacement than the outer diaphragm, enhancing the sensitivity. Further, using the inner and outer diaphragms to respond to different sound wave pressures can enhance the sound wave pressure sensing range.

7 Claims, 5 Drawing Sheets

DUAL-DIAPHRAGM ACOUSTIC TRANSDUCER

BACKGROUND OF THE INVENTION

1. Field of the Invention

The present invention relates to acoustic transducer technology, and more particularly to a dual-diaphragm acoustic transducer for converting sound waves to electrical signals.

2. Description of the Related Art

With the rapid development of the 4C electronics (computer, communication, consumer electronics and car industries), mobile communication products such as smart phone, Bluetooth headset and microphone have become one of the mainstreams. Due to the demand for higher tone quality of mobile communication products is increasing, an acoustic transducer for use in the aforesaid mobile communication products must have good sensitivity.

A relevant prior art acoustic transducer, for example, U.S. Pat. No. 8,104,354 discloses a capacitance sensor that comprises a substrate, a sensing device, a movable frame, a first electrode and a second electrode respectively mounted at the substrate corresponding to the sensing device and the movable frame, and some spring members connecting the movable frame and the sensing device. When a sound wave pressure acts on the sensing device, the sensing device will move vertically relative to the first electrode (see FIG. 8B of the prior art), causing a change of the capacitance value therebetween and a relative change of the voltage that is induced across the capacitance. However, this design adopts one single sensing device (one single diaphragm), and this single sensing device may be unable to sense a very small volume of sound, lowering the sensitivity. Increasing the sensitivity must increase the sensing area of the sensing device. However, increasing the sensing area will affect the arrangement of the configuration of the whole structure.

SUMMARY OF THE INVENTION

The present invention has been accomplished under the circumstances in view. It is the main object of the present invention to provide a dual-diaphragm acoustic transducer, which enhances the sound pressure sensing range and improves the sensitivity without increasing the sensing area.

To achieve this and other objects of the present invention, a dual-diaphragm acoustic transducer of the present invention comprises a substrate, a sound wave sensing unit, and a support unit. The substrate comprises a first side, a second side opposite to the first side, and an opening cut through the first side and the second side. The sound wave sensing unit is mounted at the first side of the substrate to face toward the opening, comprising an inner diaphragm and an outer diaphragm. The outer diaphragm surrounds the inner diaphragm. The support unit comprises at least two elastic supporting members connected between the inner diaphragm and outer diaphragm of the sound wave sensing unit.

Preferably, the support unit further comprises a supporting base affixed to the substrate. The supporting base is provided for the connection of the outer diaphragm directly or by means of at least two symmetrical elastic supporting members, thereby rendering a support effect.

Preferably, the first side of the substrate provides a back plate that is covered over the sound wave sensing unit. The back plate carries an electrode unit that faces toward the sound wave sensing unit. The electrode unit comprises an inner electrode and an outer electrode. The inner electrode and the outer electrode are respectively arranged corresponding to the inner diaphragm and the outer diaphragm so that a respective capacitance is created between the inner electrode/outer electrode and the inner diaphragm/outer diaphragm. When the voltage induced across each capacitance changes subject to vibration of the inner or outer diaphragm, the current induced across each capacitance will change relatively to output an electrical signal.

Thus, subject to the arrangement of the inner and outer diaphragms and the connection of the multiple elastic supporting members, the dual-diaphragm acoustic transducer enables the inner diaphragm to have a relatively larger amount of vertical displacement than the outer diaphragm when the inner and outer diaphragms are simultaneously forced by a sound wave pressure, thereby enhancing the sensitivity when the sensing area remains unchanged.

Other advantages and features of the present invention will be fully understood by reference to the following specification in conjunction with the accompanying drawings, in which like reference signs denote like components of structure.

DETAILED DESCRIPTION OF THE INVENTION

Figure 1:
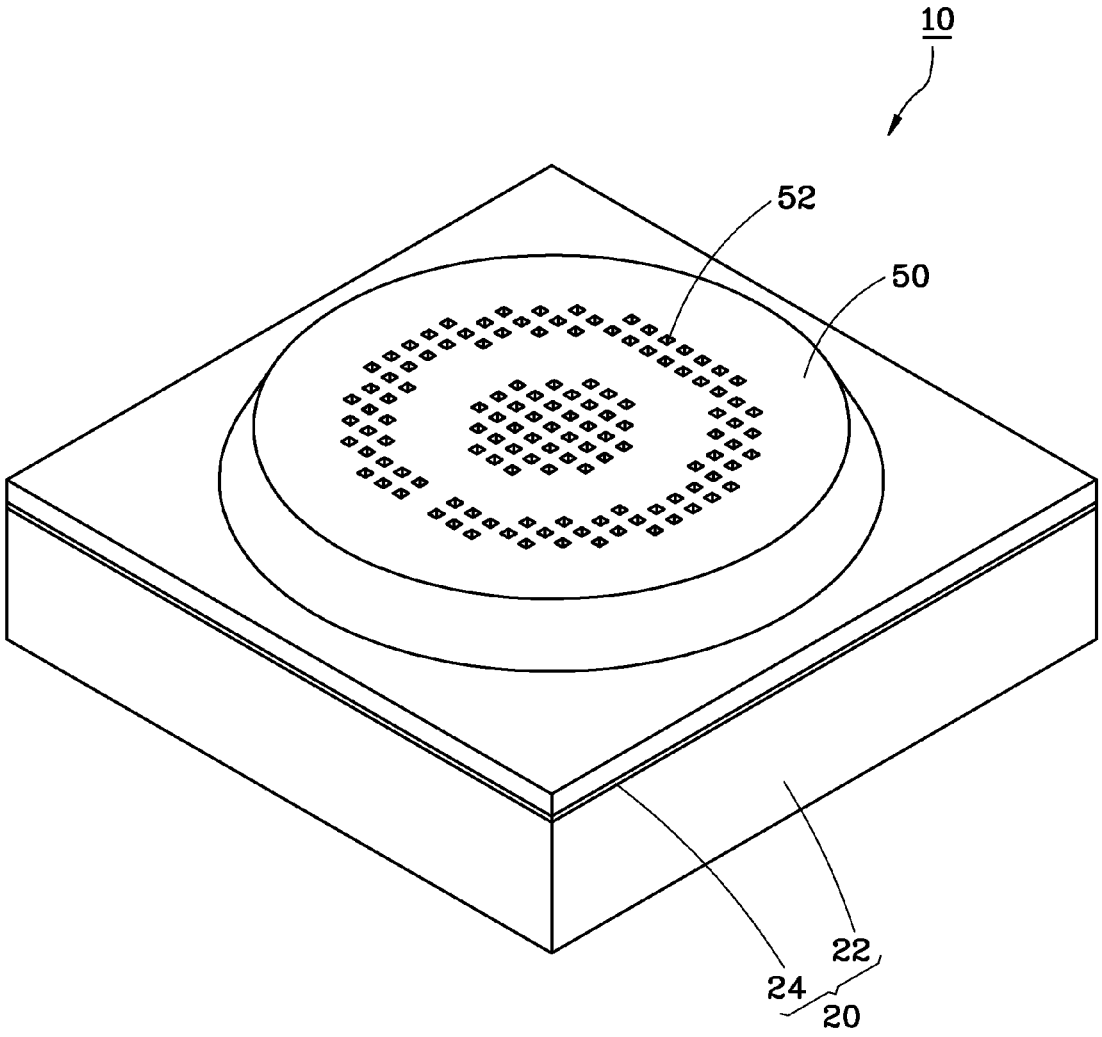
FIG. 1 is an oblique top elevational view of a dual-diaphragm acoustic transducer in accordance with a first embodiment of the present invention.
Figure 2:
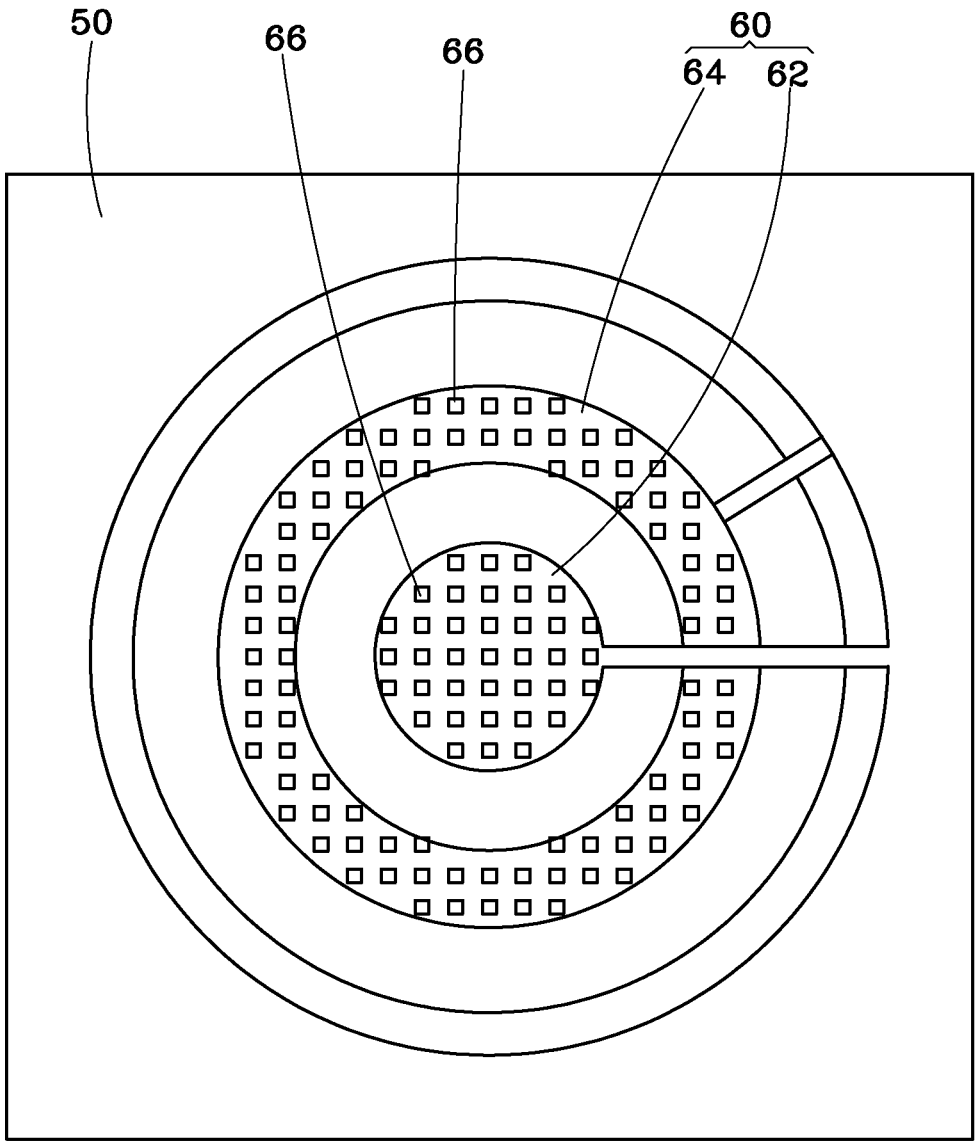
FIG. 2 is a bottom view of the dual-diaphragm acoustic transducer in accordance with the first embodiment of the present invention.
Figure 3:
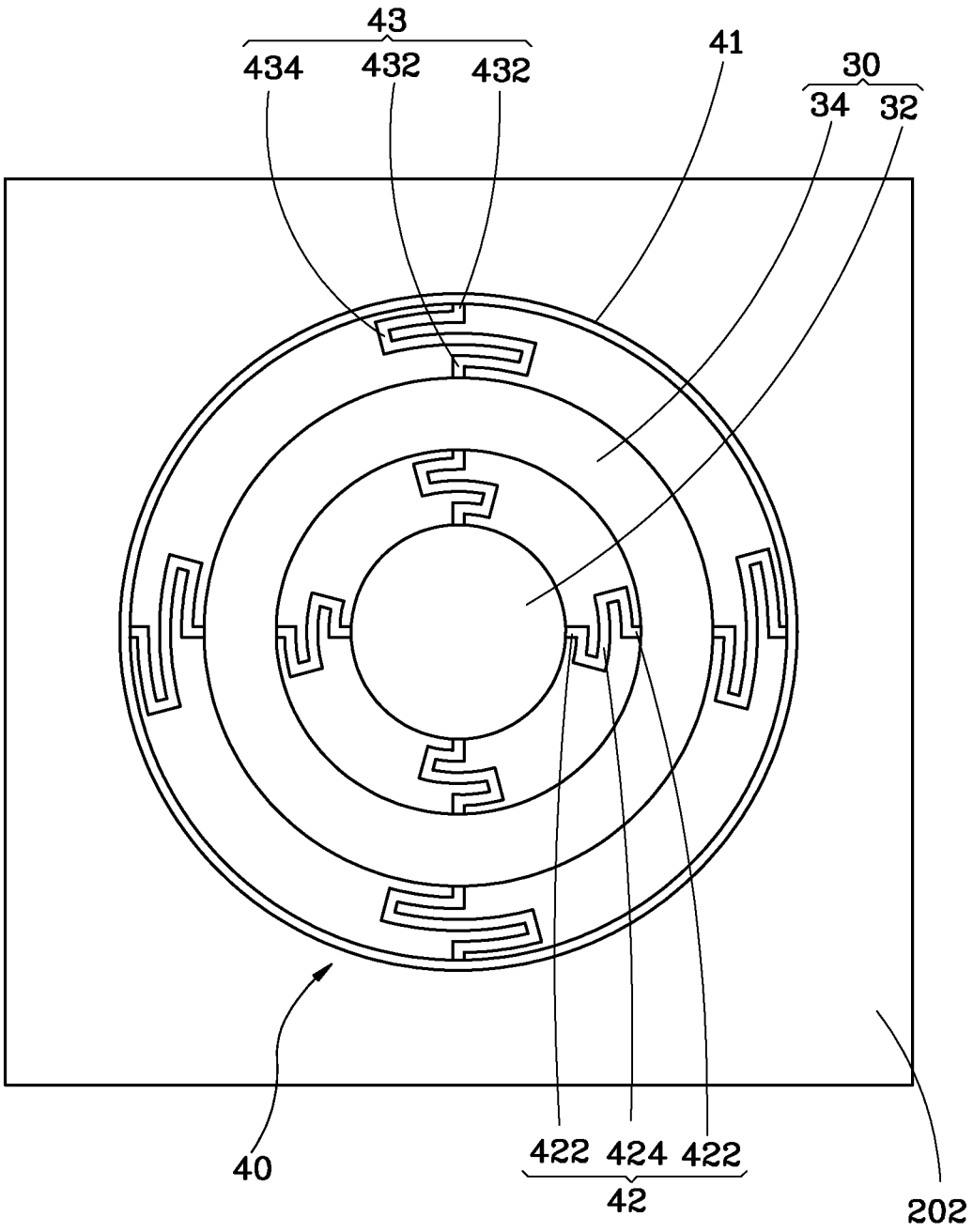
FIG. 3 is a top plain view of the dual-diaphragm acoustic transducer in accordance with the first embodiment of the present invention.

Referring to FIGS. 1-3, a dual-diaphragm acoustic transducer 10 in accordance with a first embodiment of the present invention is shown. The dual-diaphragm acoustic transducer 10 comprises a substrate 20, a sound wave sensing unit 30, and a support unit 40.

Figure 4:
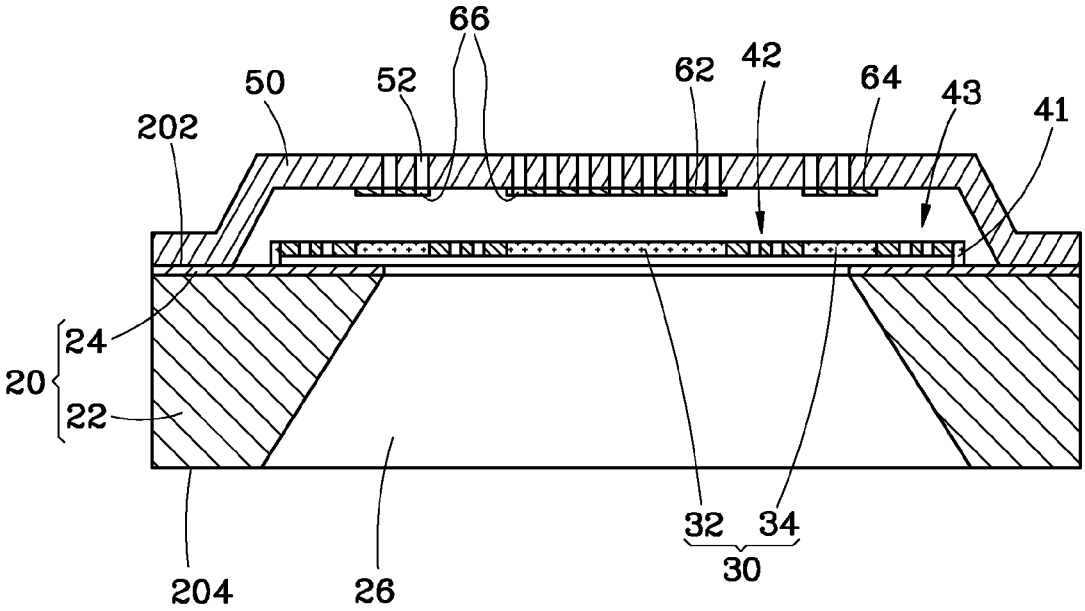
FIG. 4 is a sectional view of the dual-diaphragm acoustic transducer in accordance with the first embodiment of the present invention.

Referring also to FIG. 4, the substrate 20 comprises a silicon layer 22, and an insulating layer 24 covered on the top surface of the silicon layer 22. Thus, the top surface of the insulating layer 24 and the bottom surface of the silicon layer 22 are respectively defined as opposing first side 202 and second side 204 of the substrate 20. Further, the substrate 20 comprises an opening 26 cut through the first side 202 and the second side 204 for the passing of sound waves.

As shown in FIG. 3 and FIG. 4, the sound wave sensing unit 30 is mounted at the first side 202 of the substrate 20 corresponding to the opening 26, comprising an inner diaphragm 32 and an outer diaphragm 34 extending around the inner diaphragm 32. The inner diaphragm 32 is preferably circularly shaped. Alternatively, the inner diaphragm 32 can be configured having a rectangular shape or any other geometric shape. Further, the outer diaphragm 34 is preferably annularly shaped. Alternatively, the outer diaphragm 34 can be shaped like a rectangular loop or any other geometric loop.

As shown in FIG. 3, the support unit 40 in this embodiment comprises a supporting base 41, four first elastic supporting members 42, and four second electric supporting members 43. The supporting base 41 is fixedly mounted at the first side 202 of the substrate 20 around the outer diaphragm 34. The first elastic supporting members 42 are arranged in pairs and connected between the inner diaphragm 32 and the outer diaphragm 34, each comprising two first connection segments 422 and one first continuously curved segment 424. The two first connection segments 422 are respectively connected to the outer perimeter of the inner diaphragm 32 and the inner perimeter of the outer diaphragm 34. The first continuously curved segment 424 is connected between the two first connection segments 422. The second elastic supporting members 43 are arranged in pairs and connected between the supporting base 41 and the outer diaphragm 34, each comprising two second connection segments 432 and one second continuously curved segment 434. The two second connection segments 432 are respectively connected to the inner perimeter of the supporting base 41 and the outer perimeter of the outer diaphragm 34. The second continuously curved segment 434 is connected between the two second connection segments 432. It is to be noted that the number of the first elastic supporting members 42 and the number of the second elastic supporting members 43 are not limited to 4. Actually, at least two or three first elastic supporting members 42 and second elastic supporting members 43 can achieve optimal supporting effects, however, 4 is the best choice.

In addition to the aforesaid structure, the dual-diaphragm acoustic transducer 10 further comprises a back plate 50 and an electrode unit 60. As shown in FIGS. 1, 2 and 4, the back plate 50 is fixedly mounted at the first side 202 of the substrate 20 and covered over the sound wave sensing unit 30. The electrode unit 60 is mounted at one side of the back plate 50 that faces toward the sound wave sensing unit 30, comprising an inner electrode 62 and an outer electrode 64. The inner electrode 62 and the outer electrode 64 are respectively arranged corresponding to the inner diaphragm 32 and the outer diaphragm 34 so that a respective capacitance is respectively created between the inner/outer electrode 62/64 and the inner/outer diaphragm 32/34. Further, the back plate 50 defines a plurality of first through holes 52. The inner electrode 62 and the outer electrode 64 respectively define a plurality of second through holes 66. The first through holes 52 are respectively disposed in communication with the second through holes 66 for the passing of sound waves.

Figure 5:
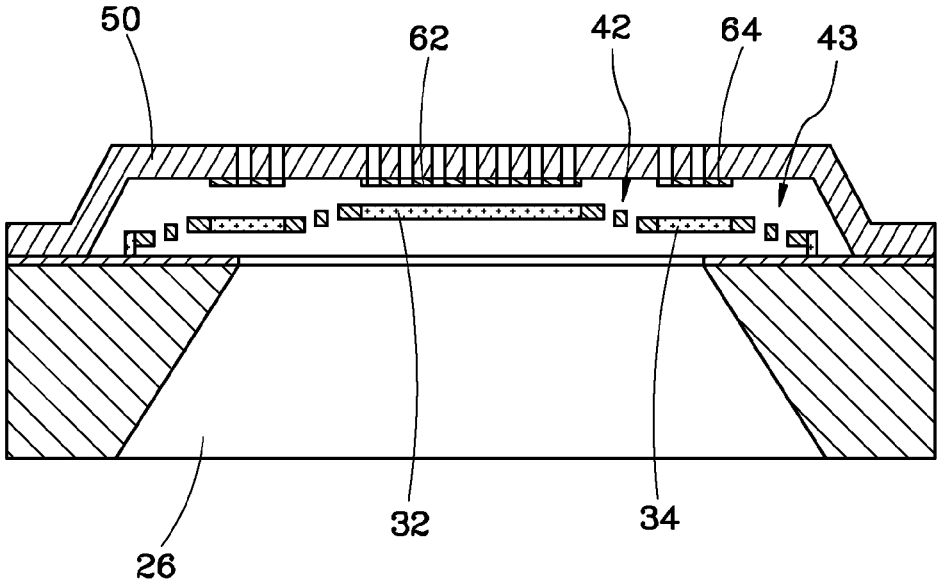
FIG. 5 is a schematic drawing illustrating an operational status of the dual-diaphragm acoustic transducer in accordance with the first embodiment of the present invention.

Referring to FIGS. 4 and 5, when a sound wave enters the opening 26 of the substrate 20, the pressure of the incident sound wave forces the outer diaphragm 34 to displace in direction toward the back plate 50. During displacement of the outer diaphragm 34, the first elastic supporting members 42 carry the inner diaphragm 32 to displace in direction toward the back plate 50. At this time, the pressure of the incident sound wave also causes the inner diaphragm 32 to displace in direction toward the back plate 50. Under the double effect of the pressure of the incident sound wave and the pulling force of the outer diaphragm 34, the inner diaphragm 32 produces a relatively larger amount of displacement than the outer diaphragm 34. At this time, the capacitance induced between the inner/outer diaphragm 32/34 and the inner/outer electrode 62/64 are changed subject to displacement of the inner diaphragm 32 and displacement of the outer diaphragm 34, causing change of voltage and current, and therefore a respective acoustic signal is produced.

When the incident sound wave disappears, the inner diaphragm 32 and the outer diaphragm 34 will be returned and kept apart from the inner electrode 62 and the outer electrode 64 by the elastic potential energy of the first elastic supporting members 42 and the second elastic supporting members 43, preventing the problem of adhesions between the inner/outer diaphragm 32/34 and the inner/outer electrode 62/64.

In conclusion, subject to the arrangement of the inner and outer diaphragms 32&34 and the connection of the multiple elastic supporting members 42&43, the dual-diaphragm acoustic transducer 10 enables the inner diaphragm 32 to have a relatively larger amount of vertical displacement than the outer diaphragm 34 when the inner and outer diaphragms 32&34 are simultaneously forced by a sound wave pressure, thereby enhancing the sensitivity. Thus, the inner diaphragm 32 can be used to respond to high sensitivity sound waves, and the outer diaphragm 34 can be used to respond to high-pressure sound waves. Using the inner and outer diaphragms to respond to a relatively smaller sound wave pressure and a relatively larger sound wave pressure respectively can enhance the sound wave pressure sensing range. Further, by means of combining different acoustic signals sensed by the inner and outer diaphragms can further improve the signal-to-noise ratio. Therefore, no matter the size of the sound, the dual-diaphragm acoustic transducer 10 of the present invention can offer optimized sensing results.

Figure 6:
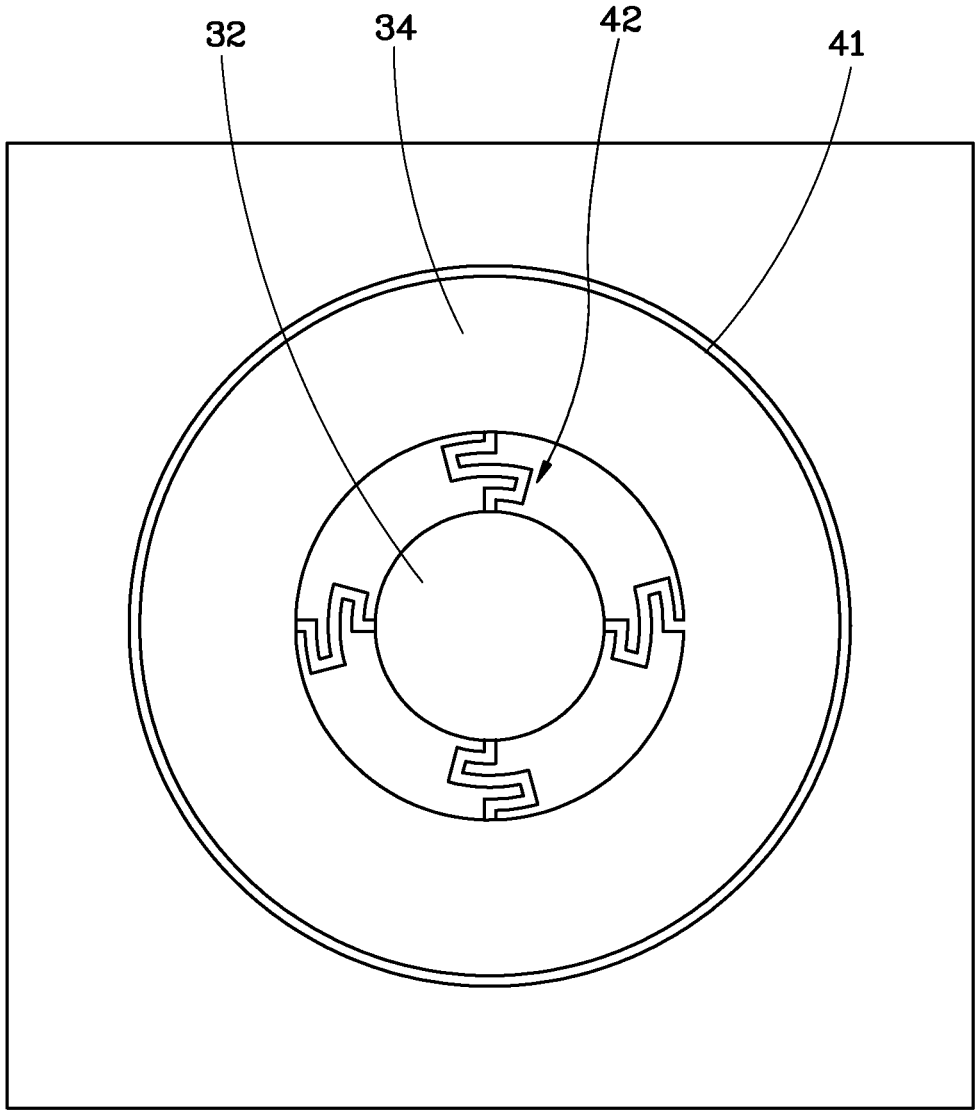
FIG. 6 is a top plain view of a dual-diaphragm acoustic transducer in accordance with a second embodiment of the present invention.

Finally, it is to be noted that the structure of the present invention can be variously embodied. For example, in a second embodiment of the present invention, as shown in FIG. 6, the outer perimeter of the outer diaphragm 34 is directly affixed to the supporting base 41 without through the second elastic supporting members 43, simplifying the whole structure. When a sound wave pressure acts on this structural arrangement, the amount of displacement of the outer diaphragm 34 is not larger than the aforesaid first embodiment, however, subject to the effect of the first elastic supporting members 42, the amount of vertical displacement of the inner diaphragm 32 can still be increased, achieving enhancement of the sensitivity.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A dual-diaphragm acoustic transducer, comprising:

a substrate comprising a first side, a second side opposite to said first side, and an opening cut through said first side and said second side; a sound wave sensing unit mounted at said first side of said substrate corresponding to said opening, said sound wave sensing unit comprising an inner diaphragm and an outer diaphragm surround said inner diaphragm; and a support unit comprising at least two first elastic supporting members connected between said inner diaphragm and said outer diaphragm of said sound wave sensing unit.

2. The dual-diaphragm acoustic transducer as claimed in claim 1, wherein each said first elastic supporting member comprising two first connection segments and one first continuously curved segment, said two first connection segments being respectively connected to the outer perimeter of said inner diaphragm and the inner perimeter of said outer diaphragm, said first continuously curved segment being connected between said two first connection segments.

3. The dual-diaphragm acoustic transducer as claimed in claim 1, wherein said support unit further comprises a supporting base and at least two second elastic supporting members, said supporting base being fixedly mounted at said first side of said substrate and extending around said outer diaphragm, said two second elastic supporting members being connected between said supporting base and said outer diaphragm.

4. The dual-diaphragm acoustic transducer as claimed in claim 3, wherein each said second elastic supporting member comprises two second connection segments and one second continuously curved segment, said two second connection segments being respectively connected to the inner perimeter of said supporting base and the outer perimeter of said outer diaphragm, said second continuously curved segment being connected between said two second connection segments.

5. The dual-diaphragm acoustic transducer as claimed in claim 1, wherein said support unit further comprises a supporting base fixedly mounted at said first side of said substrate and extending around said outer diaphragm, said outer diaphragm is directly connected with the outer perimeter thereof to said supporting base.

6. The dual-diaphragm acoustic transducer as claimed in claim 1, wherein said first side of said substrate is mounted with a back plate, said back plate being covered over said sound wave sensing unit, said back plate carrying an electrode unit at one side thereof and facing toward said sound wave sensing unit, said electrode unit comprising an inner electrode and an outer electrode respectively disposed corresponding to said inner diaphragm and said outer diaphragm.

7. The dual-diaphragm acoustic transducer as claimed in claim 6, wherein said back plate comprises a plurality of first through holes; said inner electrode and said outer electrode of said electrode unit each comprise a plurality of second through holes respectively disposed in communication with said first through holes.

* * * * *

UNITED STATES PATENT AND TRADEMARK OFFICE

CERTIFICATE OF CORRECTION

PATENT NO. : 9,036,838 B2
APPLICATION NO. : 13/939454
DATED : May 19, 2015
INVENTOR(S) : Jen-Yi Chen et al.

It is certified that error appears in the above-identified patent and that said Letters Patent is hereby corrected as shown below:

ON THE TITLE PAGE

"(71) Applicant: MERRY ELECTRONICS (SHENZHEN) CO., LTD., Shenzhen (TW)"

should read:

--(71) Applicant: MERRY ELECTRONICS (SHENZHEN) CO., LTD., Shenzhen (CN)--

Signed and Sealed this
Seventeenth Day of May, 2016

Michelle K. Lee

Michelle K. Lee
*Director of the United States Patent and Trademark Office*